US010941364B2

(12) United States Patent
Joh et al.

(10) Patent No.: US 10,941,364 B2
(45) Date of Patent: Mar. 9, 2021

(54) METHOD AND DEVICE FOR THE DESULPHURISATION OF A GAS STREAM CONTAINING HYDROGEN SULPHIDE

(71) Applicant: Siemens Aktiengesellschaft, Munich (DE)

(72) Inventors: Ralph Joh, Seligenstadt (DE); Jenny Larfeldt, Finspang (SE); Christoph Starke, Berlin (DE); Rüdiger Schneider, Eppstein (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 16/609,643

(22) PCT Filed: Apr. 16, 2018

(86) PCT No.: PCT/EP2018/059620
§ 371 (c)(1),
(2) Date: Oct. 30, 2019

(87) PCT Pub. No.: WO2018/206228
PCT Pub. Date: Nov. 15, 2018

(65) Prior Publication Data

US 2020/0063055 A1 Feb. 27, 2020

(30) Foreign Application Priority Data

May 9, 2017 (DE) ..... 10 2017 207 773.5

(51) Int. Cl.
*C10L 3/10* (2006.01)

(52) U.S. Cl.
CPC ..... *C10L 3/103* (2013.01); *C10L 2270/04* (2013.01); *C10L 2290/12* (2013.01); *C10L 2290/541* (2013.01)

(58) Field of Classification Search
CPC ..... C10L 2270/04; C10L 2290/12; C10L 2290/541; C10L 2290/544; C10L 2290/562; C10L 3/10; C10L 3/103
See application file for complete search history.

(56) References Cited

U.S. PATENT DOCUMENTS 10,556,203 B2 * 2/2020 Joh ..... B01D 53/1468
2018/0104641 A1 * 4/2018 Joh ..... C10L 3/103

FOREIGN PATENT DOCUMENTS

JP S63297496 A 12/1988
WO 2014170047 A1 10/2014
WO 2016180555 A1 11/2016

OTHER PUBLICATIONS

PCT International Search Report and Written Opinion of International Searching Authority dated Jun. 29, 2018 corresponding to PCT International Application No. PCT/EP2018/059620 filed Apr. 16, 2018.

* cited by examiner

*Primary Examiner* — Cabrena Holecek

(57) ABSTRACT

A method for the desulphurisation of a gas stream containing hydrogen sulphide, in particular a combustion gas stream used for combustion in a gas turbine, wherein the gas stream is brought into contact with a scrubbing medium containing a catalyst to absorb the hydrogen sulphide, forming elementary sulphur; the catalyst is reduced on formation of the elementary sulphur; the scrubbing medium containing the reduced catalyst is fed to a regeneration stage in which the reduced catalyst is regenerated by oxidation with an oxygen-containing gas which is fed to the regeneration stage; the oxygen-containing gas is fed to the regeneration stage from a compression stage of the gas turbine; and the gas which is depleted of oxygen during regeneration of the catalyst is fed (Continued)

to at least one turbine stage fluidically connected downstream of the compression stage.

15 Claims, 1 Drawing Sheet

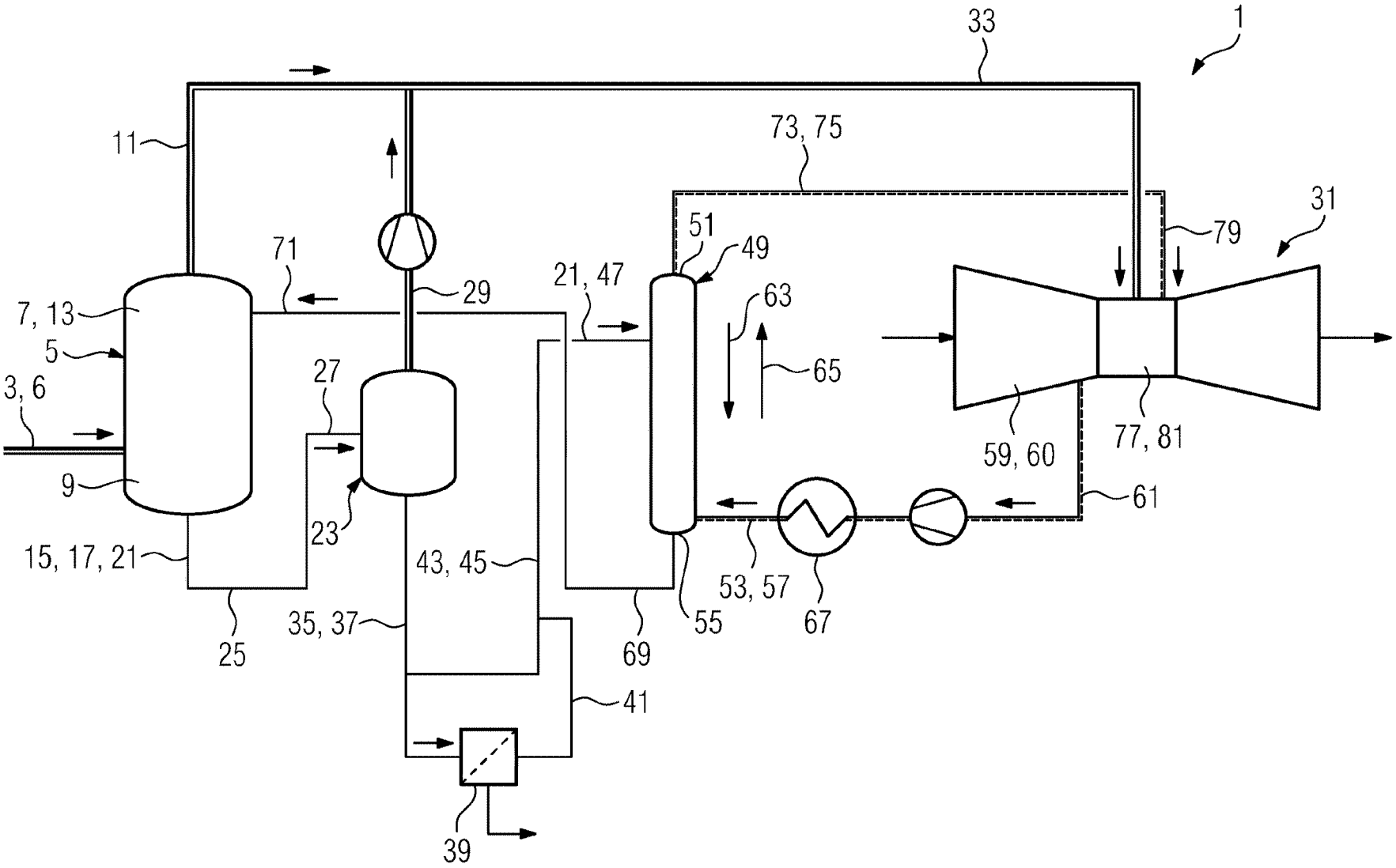
1
31
79
77, 81
61
33
59, 60
73, 75
65
63
67
49
51
53, 57
55
69
21, 47
41
29
43, 45
39
27
23
35, 37
71
25
11
7, 13
5
3, 6
9
15, 17, 21

METHOD AND DEVICE FOR THE DESULPHURISATION OF A GAS STREAM CONTAINING HYDROGEN SULPHIDE

CROSS REFERENCE TO RELATED APPLICATIONS

This application is the US National Stage of International Application No. PCT/EP2018/059620 filed 16 Apr. 2018, and claims the benefit thereof. The International Application claims the benefit of German Application No. DE 10 2017 207 773.5 filed 9 May 2017. All of the applications are incorporated by reference herein in their entirety.

FIELD OF INVENTION

The invention relates to a method for desulfurizing a gas stream comprising hydrogen sulfide, more particularly a gas stream which can be utilized for combustion in a gas turbine. The invention further relates to an apparatus for desulfurizing a gas stream comprising hydrogen sulfide.

BACKGROUND OF INVENTION

Natural gas is a fossil fuel with comparatively low ejection of carbon dioxide ($CO_2$) and comparatively low emissions of other waste products in the course of combustion. Its contribution as one of the world's most important energy resources continues to rise. Against the background of dwindling raw materials, continually increasing energy demand, and rising prices for high-value fossil fuels, the utilization of nonspecification fuels is increasingly gaining significance. For example, there is a growing interest in using acidic gases as well for direct conversion to electricity. Against this background, in the field of gas exploration (acidic natural gases) and in the gas processing sector, there is frequently also a demand for electrical energy particularly to cover the inherent requirement of machines such as compressors, for example, or further requirements.

The most efficient way of generating energy is to use gas turbines. Globally, therefore, gas turbines are being used—alone or in combination with heat recovery steam generators, water-steam circuits, and steam turbines (combined cycle power stations)—for provision of mechanical and electrical energy. However, possibilities for the direct utilization of crude natural gas have so far been limited by the presence therein of acidic constituents, such as hydrogen sulfide ($H_2S$) in particular. Undisrupted and energy-efficient operation of gas turbines requires limitation of the sulfur content of the fuel gas, both in order to avoid or at least reduce high-temperature corrosion and to meet the globally tightened emissions limits on sulfur oxides ($SO_x$). Fuel gases containing hydrogen sulfide, and acidic natural gases in particular, therefore require appropriate treatment.

For the treatment of natural gas, there are widely developed and tested methods available. An objective of these methods is to produce natural gas in a quality that meets the global specifications for entry into gas pipeline networks. This means that as well as hydrogen sulfide, other unwanted accompaniments, such as $CO_2$, $N_2$, and possibly also long-chain hydrocarbons, for example, must be removed from the natural gas in order to permit the specified calorific value and to enable unproblematic transport in a pipeline.

In the corresponding gas treatment facilities, $H_2S$ and $CO_2$ are scrubbed from the natural gas in general by means of absorption-desorption methods. Because of the toxicity, the $H_2S$ removed is frequently converted in these facilities into elemental sulfur by the method known as the Claus process. To remove inert gas such as $N_2$ and also hydrocarbons, additional operating steps are required, such as low-temperature condensation methods, for example. Because these operating steps involve high levels of apparatus-related expenditure and are correspondingly complex, the facilities in question can be operated economically only if they are capable of processing very large quantities of natural gas.

In general, therefore, natural gas treatment and electricity generation using gas turbines take place separately from one another. Gas treatment here is commonly carried out centrally, for which the crude gas for treatment is transported from various sources to the treatment facility, cleaned, and then redistributed. From an economic standpoint, however, this operating regime is inconvenient and costly.

In order to generate electricity using natural gas, often only some of the operating steps described above are needed. Provided the calorific value of the crude gas for conversion to electricity is sufficiently high, neither $CO_2$ nor inert gases represent a problem at the combustion stage. The only task unavoidable in any case, as already set out, is to remove $H_2S$. For that purpose, then, on account of the reduced capacity requirements, alternative methods come into consideration that are less complex and involve less demanding apparatus. As a result, the direct conversion of acidic gas becomes particularly attractive.

Particularly appropriate for the removal of $H_2S$ from a fuel gas are what are called liquid redox methods. These liquid redox methods are based on the concept of reactive absorption, in this case a combination of absorption and oxidation. To remove the hydrogen sulfide from the gas in question, the latter is contacted with a scrubbing medium, and the hydrogen sulfide within the gas is bound chemically or physically on an active substance of the scrubbing medium. The fuel gas cleaned to remove hydrogen sulfide can then be directly burned or converted into electricity in a gas turbine.

The scrubbing medium containing hydrogen sulfide is subsequently treated by a catalyst (also referred to as catalytically active components or redox agents), which converts hydrogen sulfide in the scrubbing medium into elemental sulfur and so removes the hydrogen sulfide from the scrubbing medium. In oxidizing the hydrogen sulfide, the catalyst itself is reduced ($H_2S$ conversion). To maintain the activity of the catalyst and to be able to reuse the scrubbing medium in a circuit, it is necessary for the catalyst to be oxidatively regenerated. Generally speaking, this is accomplished by absorption of oxygen from the surrounding air. For this purpose, the scrubbing medium for regeneration, comprising the reduced catalyst, is brought into contact intensively with air in an operating step downstream of the $H_2S$ removal, in a corresponding regeneration stage (for example, a bubble column in the form of a contact apparatus). Contact with the oxygen-containing gas results in oxidative regeneration of the catalyst (and hence also of the scrubbing medium).

The oxygen-containing gas needed for catalyst regeneration is typically supplied by way of blowers set up additionally for this purpose, or by gassing with externally fed, oxygen-containing air which is compressed beforehand. The energy needed to blow in the air in this case represents a key contributor to the operational costs arising in the liquid redox methods. In general, therefore, these methods are designed so as to minimize the pressure difference which the blowers have to overcome. For economic reasons, therefore, catalyst regeneration is in general not carried out at pressures upward of 1 or 2 bar absolute. This means in turn that the container volumes for catalyst regeneration are comparatively large, or cannot be reduced in size, so rendering the use of liquid redox methods unattractive, for example, for offshore applications.

SUMMARY OF INVENTION

The object on which the invention is based, therefore, is that of specifying a means which permits efficient and cost-effective conversion of gases, and especially natural gases, into electricity.

This object is achieved in accordance with the invention by the features of the independent claims. Advantageous embodiments of the invention are set out in the dependent claims and in the description hereinafter.

Within the method of the invention, a gas stream comprising hydrogen sulfide, and more particularly a gas stream which can be utilized for combustion in a gas turbine, is desulfurized by the contacting of the gas stream with a catalyst-comprising scrubbing medium for absorbing the hydrogen sulfide and with formation of elemental sulfur, where the catalyst is reduced in forming the elemental sulfur. The scrubbing medium with the reduced catalyst is fed to a regeneration stage, in which the reduced catalyst is regenerated by oxidation with an oxygen-containing gas fed to the regeneration stage, the oxygen-containing gas being fed to the regeneration stage from a compression stage of a gas turbine. In accordance with the invention, the oxygen-depleted gas from the regeneration of the catalyst is fed at least to one turbine stage, connected fluidically downstream of the compression stage of the gas turbine.

Through the targeted integration of gas treatment and gas turbine operation, the method of the invention enables economic catalyst regeneration even under high pressure. For this purpose, a small substream of the compressed combustion air is withdrawn from a suitable compression stage (compressor stage) of the gas turbine and then passed through the regeneration stage (contact apparatus) for catalyst regeneration. Following the regeneration of the catalyst, the oxygen-depleted gas, in other words the waste air, is fed to the gas turbine again. This feeding is carried out in a targeted way to the compression stage or to the pressure stage of the gas turbine that corresponds to the pressure of the waste air stream.

In other words, the waste air from the regeneration stage is fed into a turbine stage which is connected downstream, in the flow direction, of the combustion air flowing through the gas turbine. The essential advantage of this connection variant is that in this case the necessary turbine design adaptations are minimal. In particular, as well, there is no effect on the highly optimized flow conditions within the respective compression stage of the gas turbine.

For the purposes of the invention, a suitable compression stage, in other words a compressor stage, is understood in particular as being a compression stage of this kind that allows the oxygen-containing gas to be withdrawn at a pressure level which permits the gas to be utilized directly in the regeneration stage. In particular, it is possible to omit any decompression of the oxygen-containing gas before entry into the regeneration stage.

Moreover, the compression stages of a gas turbine operate with high energy efficiency. Because the air coupled out of the gas turbine is withdrawn hot, and hence at a high temperature level, and is cooled and fed back into the gas turbine at this lower temperature level, there is an efficiency advantage for the gas turbine.

The waste air, being the oxygen-depleted gas from the regeneration of the catalyst, and which leaves the regeneration stage again, still has a high pressure level on its exit, and accordingly can be fed to a turbine stage connected fluidically downstream of the compression stage. Both the withdrawal of air (oxygen-containing gas) and its feeding back (oxygen-depleted gas or waste air of the regeneration stage) require no substantial structural modifications, let alone any redesign, of the gas turbine.

In one implementation, the oxygen-containing gas is fed to the regeneration stage from the cooling air system of the gas turbine. Particularly advantageous in this case is for the oxygen-containing gas to be withdrawn from the highest possible pressure stage of the cooling air system.

An additional effect of the significantly elevated pressure level at which the catalyst (and hence also the scrubbing medium used) is regenerated is a reduction in the structural size of the apparatus components employed. The air volume flow required is reduced by compression, and the mass flow is reduced by the increased oxygen partial pressure. As a result, there is a considerable improvement in the mass transfer of the oxygen into the scrubbing medium.

In particular, oxygen-depleted gas is fed to the combustion chamber of the gas turbine. The gas withdrawn from the gas turbine, the waste air, which is still under high pressure even on exit from the regeneration stage, is therefore fed advantageously directly into the combustion process of the gas turbine, within the combustion chamber. The combustion chamber is usefully connected fluidically downstream of the compression stage from which the gas utilized for regenerating the catalyst has been withdrawn, in the flow direction of the combustion air flowing through the gas turbine.

Here it may be necessary for the low-oxygen gas stream to have to be compressed in order to be fed into the combustion chamber. In the case of this variant of the method, in comparison to regeneration under atmospheric pressure, the air volume flow that has to be compressed is substantially smaller than if it were necessary to achieve the pressure increase required for regeneration by means of a separate compressor. From a construction standpoint as well, this embodiment represents a particularly advantageous utilization of the waste air, since it requires only one additional port. Moreover, emissions can be lessened, since the possibly contaminated waste air from the regeneration stage passes through the combustion process of the gas turbine instead, for example, of being simply blown off.

In a further embodiment, oxygen-depleted gas is utilized for cooling the turbine blades of the gas turbine. A feed of this kind allows a separate air compressor to be omitted, since in this case the gas can be fed into a correspondingly lower pressure stage or compression stage. In accordance with the invention, the feeding of oxygen-depleted gas to the combustion chamber and its utilization for cooling the turbine blades of the gas turbine are possible both separately and also jointly. In other words, it is possible to feed a substream of the oxygen-depleted gas (waste air) only to the combustion chamber or only to the turbine blade cooling system, or to withdraw two waste air substreams and feed a first substream to the combustion chamber and a second substream to the turbine blade cooling system. Feeding the waste air to alternative or additional turbine stages is likewise possible, as and when required, in accordance with the invention.

In one useful embodiment, the oxygen-containing gas withdrawn from the compression stage is cooled before entry into the regeneration stage. The heat that is released on cooling the oxygen-containing gas is usefully further utilized. In particular, the heat released in the cooling of the oxygen-containing gas is fed to a treatment apparatus for treating the scrubbing medium used. Alternatively or additionally, the invention provides for the heat released to be fed into the operation of desulfurizing the gas stream.

The cooled, oxygen-containing gas withdrawn from the compression stage is then contacted, within the regeneration stage, with the scrubbing medium comprising the reduced catalyst. In this procedure, the oxygen contained in the gas transfers from the gas phase into the scrubbing medium. The oxygen-containing gas is depleted in oxygen in this procedure. In the liquid phase, the catalyst reduced beforehand in the formation of sulfur is oxidized; the catalyst is regenerated or recovered. The scrubbing medium comprising the regenerated catalyst is then available again for removal of hydrogen sulfide and for subsequent oxidation thereof.

The scrubbing medium—comprising the reduced catalyst and elemental sulfur—is advantageously decompressed before being fed to the regeneration stage. Conventionally, a flash container is used for this purpose as the decompression stage, and the scrubbing medium is degassed in said container. Methane ($CH_4$) dissolved in the scrubbing medium, in particular, is removed during the decompression. The resulting gas stream is advantageously combined with the purified gas and fed in this form to the combustion chamber. The substantially methane-free scrubbing medium after decompression is then fed in particular to the regeneration stage.

In addition to the degassing of the scrubbing medium before it enters the regeneration stage, it is desirable to remove the elemental sulfur present in the scrubbing medium. For this purpose, advantageously, at least a substream of the scrubbing medium which as well as the reduced catalyst comprises the precipitated elemental sulfur is removed. Depending on the construction of the apparatus components used to implement the method, the precipitated sulfur can be removed at different points. The elemental sulfur is removed advantageously before the entry of the scrubbing medium into the regeneration stage. In this case the substream, for example, may be removed either before the decompression of the scrubbing medium in the flash container, or else thereafter. In the removal procedure, the quantity of sulfur removed is advantageously such that the concentration of precipitated sulfur in the scrubbing medium after the removal is about 5%.

The sulfur present in the substream is usefully removed from it. The removal takes place advantageously by means of usual separating units, such as by means of a cyclone, for example. The sulfur itself is usefully fed to a further utilization. The substream of the scrubbing medium, cleaned to remove sulfur, is fed advantageously to the regeneration stage, in order to regenerate the reduced catalyst which is still present in the scrubbing medium.

Preference is given to using an amino acid salt solution as scrubbing medium. An aqueous amino acid salt solution is useful in this case. Also possible is the use of mixtures of different amino acid salts as a scrubbing medium.

Preference is given to using a metal salt as catalyst. Suitable metal salts in this case are, in principle, those whose metal ions can exist in a plurality of oxidation states. The salts of the metals iron, manganese or copper are advantageously used. These metal salts are inexpensive to purchase and have the desired catalytic properties. Especially advantageous are metal chelate complexes which exhibit sufficiently high solubility in the aqueous formulation. For this purpose, the scrubbing medium is usefully admixed with a complexing agent such as EDTA (ethylenediaminetetraacetate), HEDTA (hydroxyethyl-ethylenediaminetetraacetate), DTPA (diethylenetriaminepentaacetate) and/or NTA (nitrilotriacetate).

The apparatus of the invention for desulfurizing a gas stream comprising hydrogen sulfide, more particularly a fuel gas stream which can be utilized for combustion in a gas turbine, comprises an absorber for absorbing hydrogen sulfide from the gas stream and forming elemental sulfur by means of a scrubbing medium comprising a catalyst, and also comprises a regeneration stage coupled fluidically to the absorber, for regenerating the catalyst reduced in the formation of sulfur, by means of an oxygen-containing gas, where the regeneration stage is fluidically coupled to a compression stage of a gas turbine, for feeding the oxygen-containing gas. In accordance with the invention, the regeneration stage is coupled fluidically to at least one compression stage of the turbine stage, connected fluidically downstream, of the gas turbine, for taking off the oxygen-depleted gas.

Within the absorber, the hydrogen sulfide contained in the gas stream is removed from a gas stream by absorption in the scrubbing medium. The scrubbing medium used in this case is advantageously an amino acid salt solution. The absorbed hydrogen sulfide reacts within the absorber by means of a catalyst present in the scrubbing medium, to form elemental sulfur, and is itself reduced in the process. The catalyst used is advantageously a metal salt which is contained in the scrubbing medium. Particularly advantageous is the use of metal chelate complexes as a catalyst.

To regenerate the catalyst, the scrubbing medium is fed to the regeneration stage connected fluidically downstream of the absorber in the flow direction of the scrubbing medium. For this purpose, the absorber usefully comprises an offtake line which is coupled fluidically to a feed line of the regeneration stage.

For the regeneration of the catalyst in the regeneration stage, a further feed line is usefully attached to the regeneration stage, and is coupled fluidically to the offtake line of a compression stage of the gas turbine. Via this fluidic coupling, starting from the compression stage, oxygen-rich gas is fed to the regeneration stage. Particularly advantageous in this case is the coupling of the regeneration stage to the highest possible pressure stage or to the highest possible compression stage of the compressor of the gas turbine. For this purpose, usefully, the feed line of the regeneration stage is coupled fluidically to the offtake line of the compression stage of the compressor of the gas turbine.

In the case of gas turbines possessing a deicing system, it is advantageous in particular if, in the case of very low external temperatures, hot air is withdrawn from a compression stage of the gas turbine in order thus to prevent unwanted icing.

After the regeneration of the catalyst, the gas depleted in oxygen as part of the reaction is fed back to the gas turbine. The oxygen-depleted gas is advantageously fed directly into the combustion process of the gas turbine. For this purpose, the regeneration stage is usefully coupled to a gas turbine combustion chamber connected fluidically downstream of the compression stage. The combustion chamber is connected fluidically downstream of the compression stage in the flow direction of the combustion air flowing through the gas turbine. For feeding the low-oxygen gas to the combustion chamber, the regeneration stage usefully comprises an offtake line which is coupled fluidically to a feed line of the gas turbine combustion chamber.

Alternatively or additionally, the regeneration stage is coupled to a cooling system, connected fluidically downstream of the compression stage, for cooling the turbine blades. For this purpose, the regeneration stage usefully comprises an offtake line which is coupled fluidically to a feed line of the cooling system.

In a further embodiment, a decompression stage, called a flash stage, is connected fluidically between the absorber and the regeneration stage. In the decompression stage, the scrubbing medium flowing out of the absorber and containing the precipitated sulfur and the reduced catalyst is decompressed. In the course of the decompression, methane is desorbed and hence its unwanted entrainment into the regeneration stage is prevented. Accumulation in the scrubbing medium will take place only to a certain degree, since in the course of the regeneration the scrubbing medium is continuously freed from methane by stripping with air. For this purpose, the decompression stage is usefully connected in the offtake line of the absorber, and so is connected fluidically downstream of the absorber in the flow direction of the scrubbing medium.

After the decompression, the substantially methane-free scrubbing medium is taken off via an offtake line connected to the decompression stage, and is fed to the regeneration stage.

For the removal of sulfur from the scrubbing medium, there is advantageously a withdrawal line included for withdrawing a substream of the scrubbing medium. The withdrawal line may be connected in principle at various positions in the apparatus, with advantages being given to withdrawal from the decompression stage in the form of a flash container. Accordingly, the withdrawal line is usefully connected to the decompression stage. In this way, a part of the elemental sulfur precipitated during the oxidation of the hydrogen sulfide can be removed from the scrubbing medium. The advantageous concentration of the precipitated sulfur remaining in the scrubbing medium after the removal is about 5%.

The sulfur is advantageously removed from the scrubbing medium in a removal unit connected fluidically downstream of the withdrawal line in the flow direction of the substream withdrawn.

Further advantageous embodiments for the apparatus are evident from the dependent claims directed to the method. In that respect, the advantages stated for the method and developments thereof can be transposed, analogously, to the apparatus.

BRIEF DESCRIPTION OF THE DRAWINGS

An exemplary embodiment of the invention will be explained in more detail in the following text on the basis of the drawing.

DETAILED DESCRIPTION OF INVENTION

The FIGURE shows an apparatus 1 for desulfurizing a gas stream 3 and more particularly for desulfurizing a fuel gas stream for a gas turbine. The gas stream 3 is fed to an absorber 5 via a feed line 6 connected to the latter, and is contacted within the absorber 5 with an aqueous amino acid salt solution as scrubbing medium 7. Within the absorber 5, hydrogen sulfide 9 present in the gas stream 3 is absorbed in the scrubbing medium 7. The gas cleaned to remove hydrogen sulfide 9 is withdrawn from the absorber 5 via an offtake line 11 and fed to the combustion in a gas turbine process.

The hydrogen sulfide 9 absorbed in the scrubbing medium 7 is oxidized to elemental sulfur 15 by a catalyst 13 present in the scrubbing medium 7, and in the present case complexed Fe(III) ions. During the oxidation of the hydrogen sulfide 9, the catalyst 13 is reduced to Fe(II) ions. The sulfur 15 precipitates as a solid, and the Fe(II) ions formed by the reduction remain in solution and are masked by EDTA as a complexing agent added to the scrubbing medium 7.

The scrubbing medium 21, comprising the reduced catalyst 17 and the elemental sulfur 15, is fed subsequently to a decompression stage (flash stage) 23 connected fluidically downstream of the absorber 5. The feed is made via a fluidic coupling between an offtake line 25 connected to the absorber 5, and a feed line 27 of the decompression stage 23.

Within the decompression stage 23, the scrubbing medium 21 is decompressed, and methane contained within it is desorbed. The desorbed methane is fed to a gas turbine 31 via an offtake line 29 connected to the decompression stage 23. For this purpose, the offtake line 29 is coupled to a feed line 33 of the gas turbine 31.

Additionally, a substream 35 of the scrubbing medium 21 is withdrawn via a withdrawal line 37 connected to the decompression stage 23. As a result of this, the concentration of precipitated sulfur 15 in the scrubbing medium 21 is lowered to a concentration of about 5%.

The substream 35 taken off from the scrubbing medium 21 is fed to a removal unit 39 in the form of a filter, in which the sulfur 15 is removed from the scrubbing medium 21. The sulfur 15 itself is fed to a further utilization. The scrubbing medium 21, cleaned to remove sulfur 15, is recycled. For this purpose, a recycle line 41 of the removal unit 39 is coupled fluidically to an offtake line 43 of the decompression stage 23. Via this coupling, the scrubbing medium 21 freed of sulfur is combined with the main stream 45 of the scrubbing medium 21.

The degassed scrubbing medium 21, cleaned to remove sulfur 15, is then fed to the top 51 of the regeneration stage 49 via a feed line 47 of said regeneration stage 49, said feed line 47 being coupled to the offtake line 43 of the decompression stage 23. Within the regeneration stage 49, the scrubbing medium 21 is contacted with an oxygen-containing gas 53 which flows into the regeneration stage 49 via a feed line 57 connected to the base 55 of the regeneration stage 49.

The oxygen-containing gas 53 here is withdrawn from a compression stage 59, in other words a compressor of the gas turbine 31. The oxygen-containing gas 53 is fed via the fluidic coupling of an offtake line 61 of the compression stage 59, in the present case of the cooling air system 60 of the gas turbine 31, to the feed line 57 of the regeneration stage 49. By way of this fluidic coupling, oxygen-containing gas 53 withdrawn from the compression stage 59 is able to flow into the regeneration stage 49 and be utilized there for regenerating the reduced catalyst 17 contained in the scrubbing medium 21. The scrubbing medium 21 is regenerated at the same time.

The oxygen-containing gas 53, in other words the air withdrawn from the gas turbine 31, flows into the regeneration stage 49 in a flow direction 65 which is opposite to the flow direction 63 of the scrubbing medium 21. Disposed in the feed line 57 of the regeneration stage 49 is a heat exchanger 67, which cools the gas 53 before entry into the regeneration stage 49. The heat taken off in this procedure can be fed into the operation at a suitable point.

The catalyst 13 is regenerated by the contact of the scrubbing medium 7 with the oxygen-containing gas 53. In this case, the oxygen present in the gas 53 transfers from the gas phase into the liquid phase. Consequently, the Fe(II) ions reduced beforehand in the formation of the sulfur are oxidized to Fe(III) ions and hence the catalyst 13 is recovered. As part of the regeneration, the scrubbing medium 7 is also recovered, and is now available again—containing the original catalyst 13—for removing hydrogen sulfide 9 from a gas stream 3. For that purpose, the regenerated scrubbing medium 7 is withdrawn via an offtake line 69 connected at the base 55 of the regeneration stage 49, and is fed to the absorber 5 by way of a fluidic coupling of the offtake line 69 to a feed line 71 of said absorber 5.

The oxygen-depleted gas 73, in other words the waste air, formed during the regeneration of the catalyst 13 within the regeneration stage 49 is then returned to the gas turbine process.

For this purpose, the oxygen-depleted gas 73 is withdrawn from the regeneration stage 49 via an offtake line 75 connected to said regeneration stage 49, and is fed to a turbine stage 77 connected fluidically downstream of the compression stage 59 of the gas turbine 31. For this feed, offtake line 75 of the regeneration stage 49 is coupled fluidically to a feed line 79 of the turbine stage 77. In the present case, the turbine stage 77 is the combustion chamber 81 of the gas turbine 31, and so the low-oxygen gas 73 flows directly into the combustion process of the gas turbine 31. Alternatively or additionally, the low-oxygen gas 73 may be utilized for cooling the turbine blades of the gas turbine 31.

An above-described procedure allows economic catalyst regeneration even under high pressure. The highly optimized flow conditions in the respective compression stage 59 of the gas turbine 31 are unaffected. As compared with regeneration of the catalyst 17 under atmospheric pressure, the air volume flow for compression when air from the compression stage 59 of a gas turbine 31 is fed in is substantially smaller for achieving the pressure increase needed for the regeneration.

The waste air, in other words the gas 73 depleted in oxygen during the regeneration of the catalyst 17, which has left the regeneration stage 49 again, still has a high pressure level on exit and can be fed accordingly to a turbine stage 77 connected fluidically downstream of the compression stage 59. Not only the withdrawal of air but also the return feed requires only minor structural modifications to the gas turbine 31, if any.

Additionally, the combustion of the low-oxygen gas 73, in other words of the waste air taken off from the regeneration stage 49, reduces unwanted emissions.

The invention, while particularly clear from the exemplary embodiment described above, is nevertheless not confined to this exemplary embodiment. Instead, further embodiments of the invention may be derived from the claims and from the description hereinabove.

The invention claimed is:

1. A method for desulfurizing a gas stream comprising hydrogen sulfide utilizable for combustion in a gas turbine, the method comprising:

contacting the gas stream with a catalyst—comprising a scrubbing medium for absorbing the hydrogen sulfide with formation of elemental sulfur, the catalyst being reduced in the formation of the elemental sulfur, supplying the scrubbing medium comprising the reduced catalyst to a regeneration stage in which the reduced catalyst is regenerated by oxidation with an oxygen-containing gas fed to the regeneration stage, feeding the oxygen-containing gas to the regeneration stage from a compression stage of the gas turbine, and feeding oxygen-depleted gas from the regeneration of the catalyst to at least one turbine stage of the gas turbine, the at least one turbine stage connected fluidically downstream of the compression stage, and utilizing the oxygen-depleted gas for cooling turbine blades of the gas turbine.

2. The method as claimed in claim 1, wherein the feeding of the oxygen-containing gas to the regeneration stage comprises feeding from a cooling air system of the gas turbine.

3. The method as claimed in claim 1, wherein the feeding of the oxygen-depleted gas to the at least one turbine stage comprises feeding to a combustion chamber of the gas turbine.

4. The method as claimed in claim 1, further comprising:

cooling the oxygen-containing gas taken from the compression stage before entry into the regeneration stage.

5. The method as claimed in claim 1, further comprising:

decompressing the scrubbing medium before being fed to the regeneration stage.

6. The method as claimed in claim 1, further comprising:

removing at least one substream of the scrubbing medium.

7. The method as claimed in claim 1, further comprising:

feeding the scrubbing medium which is regenerated to an absorber.

8. The method as claimed in claim 1, wherein an amino acid salt solution is used as scrubbing medium.

9. The method as claimed in claim 1, wherein a metal salt is used as the catalyst.

10. The method as claimed in claim 1, wherein the gas stream comprises a fuel gas stream.

11. An apparatus for desulfurizing a gas stream comprising hydrogen sulfide utilizable for combustion in a gas turbine, the apparatus comprising:

an absorber for absorbing hydrogen sulfide from the gas stream to form elemental sulfur by means of a catalyst—comprising scrubbing medium, and a regeneration stage, coupled fluidically to the absorber, for regenerating the catalyst, reduced in the formation of sulfur, by an oxygen-containing gas, wherein the regeneration stage is coupled fluidically to a compression stage of a gas turbine for feeding the oxygen-containing gas, wherein the regeneration stage is coupled fluidically to at least one compression stage of a turbine stage for taking off oxygen-depleted gas, the at least one compression stage connected fluidically downstream of the gas turbine, and wherein the regeneration stage is coupled to a cooling system connected fluidically downstream of the compression stage, for cooling turbine blades.

12. The apparatus as claimed in claim 11, wherein the regeneration stage is coupled fluidically to a cooling air system of the gas turbine, for feeding the oxygen-containing gas.

13. The apparatus as claimed in claim 11, wherein the regeneration stage is coupled to a combustion chamber connected fluidically downstream of the compression stage.

14. The apparatus as claimed in claim 11, wherein a decompression stage is connected fluidically between the absorber and the regeneration stage.

15. The apparatus as claimed in claim 11, wherein the gas stream comprises a fuel gas stream.

* * * * *